US008663359B2

(12) United States Patent
Harding et al.

(10) Patent No.: US 8,663,359 B2
(45) **Date of Patent: *Mar. 4, 2014**

(54) THICK SINTERED POLYCRYSTALLINE DIAMOND AND SINTERED JEWELRY

(75) Inventors: David P. Harding, Provo, UT (US); Mark E. Richards, Heber, UT (US); Richard H. Dixon, Provo, UT (US); Victoriano Carvajal, Provo, UT (US); Bao-Khang Ngoc Nguyen, Salt Lake City, UT (US); German A. Loesener, Provo, UT (US); A. Ben Curnow, American Fork, UT (US); Troy J. Medford, Pleasant Grove, UT (US); Trenton T. Walker, Woodland Hills, OK (US); Jeffery K. Taylor, Loomis, CA (US); Bill J. Pope, Springville, UT (US)

(73) Assignee: Dimicron, Inc., Orem, UT (US)

( * ) Notice: Subject to any disclaimer, the term of this patent is extended or adjusted under 35 U.S.C. 154(b) by 578 days.

This patent is subject to a terminal disclaimer.

(21) Appl. No.: 12/823,464

(22) Filed: Jun. 25, 2010

(65) Prior Publication Data

US 2011/0146348 A1 Jun. 23, 2011

Related U.S. Application Data

(60) Provisional application No. 61/220,811, filed on Jun. 26, 2009.

(51) Int. Cl.

| | |
|---|---|
| ***C22C 29/00*** | (2006.01) |
| ***C22C 29/02*** | (2006.01) |
| ***C22C 29/16*** | (2006.01) |

(52) U.S. Cl.

USPC ..... 75/236; 75/243; 75/244; 419/5; 419/6; 419/8; 419/11; 419/13; 419/14; 419/48

(58) Field of Classification Search

USPC ..... 75/228–250, 255, 252, 253, 254, 75/746–773, 950; 148/240–287, 516–537, 148/408, 423, 425, 442; 420/428, 429, 420/435–440, 557–562, 580, 588, 589, 590, 420/591; 428/3–12, 28, 544–687, 32, 428/539.5, 542.2, 542.4, 542.6, 542.8, 543

See application file for complete search history.

(56) References Cited

U.S. PATENT DOCUMENTS 2,254,549 A 9/1941 Small (Continued)

FOREIGN PATENT DOCUMENTS

GB 2 283 772 5/1995

(Continued)

OTHER PUBLICATIONS

Co (Cobalt) Binary Alloy Phase Diagrams, Alloy Phase Diagrams, vol. 3, ASM Handbook, ASM International, 1992.*

(Continued)

*Primary Examiner* — Scott Kastler
*Assistant Examiner* — Vanessa Luk
(74) *Attorney, Agent, or Firm* — Pate Peterson PLLC; Brett Peterson

(57) ABSTRACT

Methods of forming larger sintered compacts of PCD and other sintered ultrahard materials are disclosed. Improved solvent metal compositions and layering of the un-sintered construct allow for sintering of thicker and larger high quality sintered compacts. Jewelry may also be made from sintered ultrahard materials including diamond, carbides, and boron nitrides. Increased biocompatibility is achieved through use of a sintering metal containing tin. Methods of sintering perform shapes are provided.

12 Claims, 5 Drawing Sheets

(56) References Cited

U.S. PATENT DOCUMENTS

| | | | |
|---|---|---|---|
| 2,947,608 | A | 8/1960 | Hall |
| 2,947,609 | A | 8/1960 | Strong |
| 2,947,610 | A | 8/1960 | Hall et al. |
| 2,947,611 | A | 8/1960 | Bundy |
| 2,992,900 | A | 7/1961 | Bovenkerk |
| 3,031,269 | A | 4/1962 | Bovenkerk |
| 3,115,729 | A | 12/1963 | Render |
| 3,297,407 | A | 1/1967 | Wentorf, Jr. |
| 3,423,177 | A | 1/1969 | Bovenkerk |
| 3,488,153 | A | 1/1970 | Bundy |
| 3,574,580 | A | 4/1971 | Stromberg et al. |
| 3,597,158 | A | 8/1971 | Horton |
| 3,656,184 | A | 4/1972 | Chambers |
| 3,702,573 | A | 11/1972 | Nemeth |
| 3,819,814 | A | 6/1974 | Pope |
| 3,864,409 | A | 2/1975 | Pope |
| 3,865,585 | A | 2/1975 | Rademacher |
| 3,916,497 | A | 11/1975 | Doi |
| 4,012,229 | A | 3/1977 | Herchenroeder et al. |
| 4,089,933 | A | 5/1978 | Vereschagin et al. |
| 4,104,344 | A | 8/1978 | Pope et al. |
| 4,104,441 | A | 8/1978 | Fedoseev et al. |
| 4,163,769 | A | 8/1979 | Pope et al. |
| 4,231,762 | A | 11/1980 | Hara et al. |
| 4,259,072 | A | 3/1981 | Hirabayashi et al. |
| 4,260,203 | A | 4/1981 | Garner |
| 4,260,397 | A | 4/1981 | Bovenkerk |
| 4,380,471 | A | 4/1983 | Lee et al. |
| 4,406,871 | A | 9/1983 | Samoilovich et al. |
| 4,410,054 | A | 10/1983 | Nagel et al. |
| 4,454,612 | A | 6/1984 | McDaniel et al. |
| 4,470,158 | A | 9/1984 | Pappas et al. |
| 4,518,659 | A | 5/1985 | Gigl et al. |
| 4,525,178 | A | 6/1985 | Hall |
| 4,525,179 | A | 6/1985 | Gigl |
| 4,604,106 | A | 8/1986 | Hall et al. |
| 4,610,699 | A | 9/1986 | Yazu et al. |
| 4,662,348 | A | 5/1987 | Hall et al. |
| 4,668,290 | A | 5/1987 | Wang et al. |
| 4,714,468 | A | 12/1987 | Wang et al. |
| 4,714,473 | A | 12/1987 | Bloebaum |
| 4,729,440 | A | 3/1988 | Hall |
| 4,755,185 | A | 7/1988 | Tarr |
| 4,778,486 | A | 10/1988 | Csillag et al. |
| 4,784,023 | A | 11/1988 | Dennis |
| 4,802,539 | A | 2/1989 | Hall |
| 4,808,185 | A | 2/1989 | Penenberg et al. |
| 4,822,365 | A | 4/1989 | Walker et al. |
| 4,822,366 | A | 4/1989 | Bolesky |
| 4,865,603 | A | 9/1989 | Noiles |
| 4,925,701 | A | 5/1990 | Jansen et al. |
| 4,931,068 | A | 6/1990 | Dismukes et al. |
| 4,979,957 | A | 12/1990 | Hodorek |
| 5,002,577 | A | 3/1991 | Bolesky et al. |
| 5,002,731 | A | 3/1991 | Crook et al. |
| 5,009,673 | A | 4/1991 | Cho |
| 5,011,515 | A | 4/1991 | Frushour |
| 5,030,233 | A | 7/1991 | Ducheyne |
| 5,037,423 | A | 8/1991 | Kenna |
| 5,054,682 | A | 10/1991 | Mistry |
| 5,082,359 | A | 1/1992 | Kirkpatrick |
| 5,092,687 | A | 3/1992 | Hall |
| 5,108,432 | A | 4/1992 | Gustavson |
| 5,128,146 | A | 7/1992 | Hirayama et al. |
| 5,133,757 | A | 7/1992 | Sioshansi et al. |
| 5,152,794 | A | 10/1992 | Davidson |
| 5,152,795 | A | 10/1992 | Sioshansi et al. |
| 5,154,023 | A | 10/1992 | Sioshansi |
| 5,180,394 | A | 1/1993 | Davidson |
| 5,181,926 | A | 1/1993 | Koch et al. |
| 5,192,323 | A | 3/1993 | Shetty et al. |
| 5,211,726 | A | 5/1993 | Slutz et al. |
| 5,236,545 | A | 8/1993 | Pryor |
| 5,248,317 | A | 9/1993 | Tank et al. |
| 5,254,509 | A | 10/1993 | Gesing et al. |
| 5,258,022 | A | 11/1993 | Davidson |
| 5,278,109 | A | 1/1994 | Ono et al. |
| 5,308,412 | A | 5/1994 | Shetty et al. |
| 5,310,408 | A | 5/1994 | Schryver et al. |
| 5,330,481 | A | 7/1994 | Hood et al. |
| 5,330,826 | A | 7/1994 | Taylor et al. |
| 5,355,969 | A | 10/1994 | Hardy et al. |
| 5,358,525 | A | 10/1994 | Fox et al. |
| 5,370,694 | A | 12/1994 | Davidson |
| 5,372,660 | A | 12/1994 | Davidson et al. |
| 5,380,547 | A | 1/1995 | Higgins |
| 5,383,934 | A | 1/1995 | Armini et al. |
| 5,387,247 | A | 2/1995 | Vallana et al. |
| 5,391,407 | A | 2/1995 | Dearnaley |
| 5,391,408 | A | 2/1995 | Piera |
| 5,391,409 | A | 2/1995 | Shibata et al. |
| 5,391,422 | A | 2/1995 | Omori et al. |
| 5,414,049 | A | 5/1995 | Sun et al. |
| 5,415,704 | A | 5/1995 | Davidson |
| 5,458,827 | A | 10/1995 | Holly |
| 5,462,362 | A | 10/1995 | Yuhta et al. |
| 5,478,906 | A | 12/1995 | Howard, Jr. |
| 5,480,683 | A | 1/1996 | Chabrol et al. |
| 5,507,804 | A | 4/1996 | Llanos |
| 5,507,814 | A | 4/1996 | Gilbert et al. |
| 5,507,824 | A | 4/1996 | Lennox |
| 5,508,368 | A | 4/1996 | Knapp et al. |
| 5,512,235 | A | 4/1996 | Cerutti et al. |
| 5,516,500 | A | 5/1996 | Liu et al. |
| 5,530,072 | A | 6/1996 | Shirodkar |
| 5,554,415 | A | 9/1996 | Turchan et al. |
| 5,571,616 | A | 11/1996 | Phillips et al. |
| 5,593,719 | A | 1/1997 | Dearnaley et al. |
| 5,620,754 | A | 4/1997 | Turchan et al. |
| 5,628,824 | A | 5/1997 | Vohra et al. |
| 5,635,243 | A | 6/1997 | Turchan et al. |
| 5,641,323 | A | 6/1997 | Caldarise |
| 5,643,641 | A | 7/1997 | Turchan et al. |
| 5,645,601 | A | 7/1997 | Pope et al. |
| 5,682,595 | A | 10/1997 | Gonseth et al. |
| 5,702,448 | A | 12/1997 | Buechel et al. |
| 5,706,906 | A | 1/1998 | Jurewicz et al. |
| 5,725,573 | A | 3/1998 | Dearnaley et al. |
| 5,766,394 | A | 6/1998 | Anderson et al. |
| 5,773,140 | A | 6/1998 | Cerutti et al. |
| 5,780,119 | A | 7/1998 | Dearnaley et al. |
| 5,824,651 | A | 10/1998 | Nanci et al. |
| 5,830,539 | A | 11/1998 | Yan et al. |
| 5,855,996 | A | 1/1999 | Corrigan et al. |
| 5,868,796 | A | 2/1999 | Buechel et al. |
| 5,871,547 | A | 2/1999 | Abouaf et al. |
| 5,895,388 | A | 4/1999 | Zobel |
| 5,895,428 | A | 4/1999 | Berry |
| 5,916,269 | A | 6/1999 | Serbousek et al. |
| 5,947,893 | A | 9/1999 | Agrawal et al. |
| 5,981,827 | A | 11/1999 | Devlin et al. |
| 6,010,533 | A | 1/2000 | Pope et al. |
| 6,063,149 | A | 5/2000 | Zimmer |
| 6,077,148 | A | 6/2000 | Klein et al. |
| 6,183,818 | B1 | 2/2001 | Vohra et al. |
| 6,207,218 | B1 | 3/2001 | Layrolle et al. |
| 6,221,108 | B1 | 4/2001 | Smith |
| 6,290,726 | B1 | 9/2001 | Pope et al. |
| 6,398,815 | B1 | 6/2002 | Pope et al. |
| 6,402,787 | B1 | 6/2002 | Pope et al. |
| 6,410,877 | B1 | 6/2002 | Dixon et al. |
| 6,425,922 | B1 | 7/2002 | Pope et al. |
| 6,488,715 | B1 | 12/2002 | Pope et al. |
| 6,494,918 | B1 | 12/2002 | Pope et al. |
| 6,497,727 | B1 | 12/2002 | Pope et al. |
| 6,514,289 | B1 | 2/2003 | Pope et al. |
| 6,517,583 | B1 | 2/2003 | Pope et al. |
| 6,562,462 | B2 | 5/2003 | Griffin et al. |
| 6,596,225 | B1 | 7/2003 | Pope et al. |
| 6,610,095 | B1 | 8/2003 | Pope et al. |
| 6,655,845 | B1 | 12/2003 | Pope et al. |
| 6,676,704 | B1 | 1/2004 | Pope et al. |
| 6,709,463 | B1 | 3/2004 | Pope et al. |
| 6,773,520 | B1 | 8/2004 | Fehring et al. |

(56) References Cited

U.S. PATENT DOCUMENTS

| | | | | |
|---|---|---|---|---|
| 6,793,681 | B1 | 9/2004 | Pope et al. | |
| 6,797,326 | B2 | 9/2004 | Griffin et al. | |
| 6,800,095 | B1 | 10/2004 | Pope et al. | |
| 6,817,550 | B2 | 11/2004 | Taylor et al. | |
| 7,076,972 | B2 * | 7/2006 | West | 63/15 |
| 7,077,867 | B1 | 7/2006 | Pope et al. | |
| 7,172,142 | B2 | 2/2007 | Taylor et al. | |
| 7,494,507 | B2 | 2/2009 | Dixon et al. | |
| 7,569,176 | B2 | 8/2009 | Pope et al. | |
| 7,608,333 | B2 | 10/2009 | Eyre | |
| 7,678,325 | B2 | 3/2010 | Gardinier | |
| 7,726,421 | B2 | 6/2010 | Middlemiss | |
| 2002/0102403 | A1 | 8/2002 | Leverenz et al. | |
| 2003/0019106 | A1 | 1/2003 | Pope et al. | |
| 2003/0191533 | A1 | 10/2003 | Dixon et al. | |
| 2004/0111159 | A1 | 6/2004 | Pope et al. | |
| 2004/0199260 | A1 | 10/2004 | Pope et al. | |
| 2004/0223676 | A1 | 11/2004 | Pope et al. | |
| 2005/0087915 | A1 | 4/2005 | Pope et al. | |
| 2005/0110187 | A1 | 5/2005 | Pope et al. | |
| 2005/0121417 | A1 | 6/2005 | Dixon et al. | |
| 2005/0133277 | A1 | 6/2005 | Dixon et al. | |
| 2005/0146086 | A1 | 7/2005 | Pope et al. | |
| 2005/0158200 | A1 | 7/2005 | Pope et al. | |
| 2005/0203630 | A1 | 9/2005 | Pope et al. | |
| 2006/0013718 | A1 | 1/2006 | Anderson | |
| 2006/0263233 | A1 * | 11/2006 | Gardinier | 419/11 |
| 2007/0082229 | A1 * | 4/2007 | Mirchandani et al. | 428/698 |
| 2008/0302579 | A1 | 12/2008 | Keshavan et al. | |
| 2009/0263643 | A1 * | 10/2009 | Gardinier et al. | 428/304.4 |

FOREIGN PATENT DOCUMENTS

| | | |
|---|---|---|
| GB | 2 290 326 | 12/1995 |
| GB | 2 290 327 | 12/1995 |
| GB | 2 290 328 | 12/1995 |
| JP | 01-116048 | 5/1989 |
| JP | 9173437 | 7/1997 |
| WO | WO 2009-027949 | 3/2009 |

OTHER PUBLICATIONS

RD 363004, Jul. 1994.
ISTA Symposium Presentation, Sep. 1997.
ISTA Symposium Presentation, Oct. 1998.
U.S. Appl. No. 11/435,383, filed May 16, 2006, Pope et al.
U.S. Appl. No. 11/435,392, filed May 16, 2006, Pope et al.
U.S. Appl. No. 11/957,277, filed Dec. 14, 2007, Dixon et al.

* cited by examiner

THICK SINTERED POLYCRYSTALLINE DIAMOND AND SINTERED JEWELRY

PRIORITY

The present application claims the benefit of U.S. Provisional Application Ser. No. 61/220,811, filed Jun. 26, 2009, which is herein incorporated by reference in its entirety.

THE FIELD OF THE INVENTION

The present invention relates to jewelry. More specifically, the present invention relates to jewelry formed from sintered carbides or polycrystalline diamond.

BACKGROUND

Current technology in the manufacturing of jewelry uses many different materials. Some jewelry has structural material as well as ornamental material, and in some jewelry materials are used which are both structural and decorative. As an example, men's and women's wedding bands, and other types of decorative rings made to fit the human fingers, are typically made out of three basic material categories. These categories are: metals and metal alloys, such as gold, silver, and platinum; natural occurring gemstone materials such as jade, hematite, and turquoise; and ceramics such as alumina; and recently even cemented tungsten carbide (often called tungsten). These rings often have gem stones or other materials affixed for ornamentation.

Jewelry types and material preferences tend to be influenced by current trends similar to clothing fashions. Recently, cemented tungsten carbide rings have come into vogue for men's wedding and decorative rings displacing somewhat the more traditional metal rings. The jewelry market tends to be receptive to new and unusual materials.

In the past, diamonds have been used as ornamentation on jewelry. Due to its expense, rarity, and difficulty to produce and process, it has not been used as a bulk material in rings or jewelry. Polycrystalline Diamond (PCD) is an engineered material mostly used for industrial drilling and machining. In jewelry, naturally occurring black carbonaceous diamond (sometimes called carbonado) has been cut into gem stones.

There are obstacles to using manufactured polycrystalline diamond in jewelry, including the available size and composition of the PCD. Fabricated PCD could be formed or cut into thin faces due to the limitations in thickness in which PCD is sintered (up to 0.200") using current technology. These thin faces could then be mounted in rings, on cuff-links, and on necklace pendants, for example, but could not form the bulk of many pieces of jewelry such as rings because of the size limitations of the PCD. One further barrier to the use of PCD as a bulk jewelry material is that it is historically sintered in the presence of cobalt and/or nickel, which are both known to cause skin allergies, as well as having other problems with biocompatibility.

SUMMARY OF THE INVENTION

It is an object of the present invention to provide an improved polycrystalline diamond for use in jewelry. It is a further object to provide an improved sintered carbide for use in jewelry.

According to one aspect of the invention, methods are provided for sintering thicker and larger quantities of PCD or carbide, and for sintering perform shapes of PCD or carbide.

According to another aspect of the invention, an improved sintering metal is provided which achieves improved biocompatibility.

These and other aspects of the present invention are realized in sintered carbide and polycrystalline diamond jewelry as shown and described in the following figures and related description.

BRIEF DESCRIPTION OF THE DRAWINGS

Various embodiments of the present invention are shown and described in reference to the numbered drawings wherein.

Figure 1:
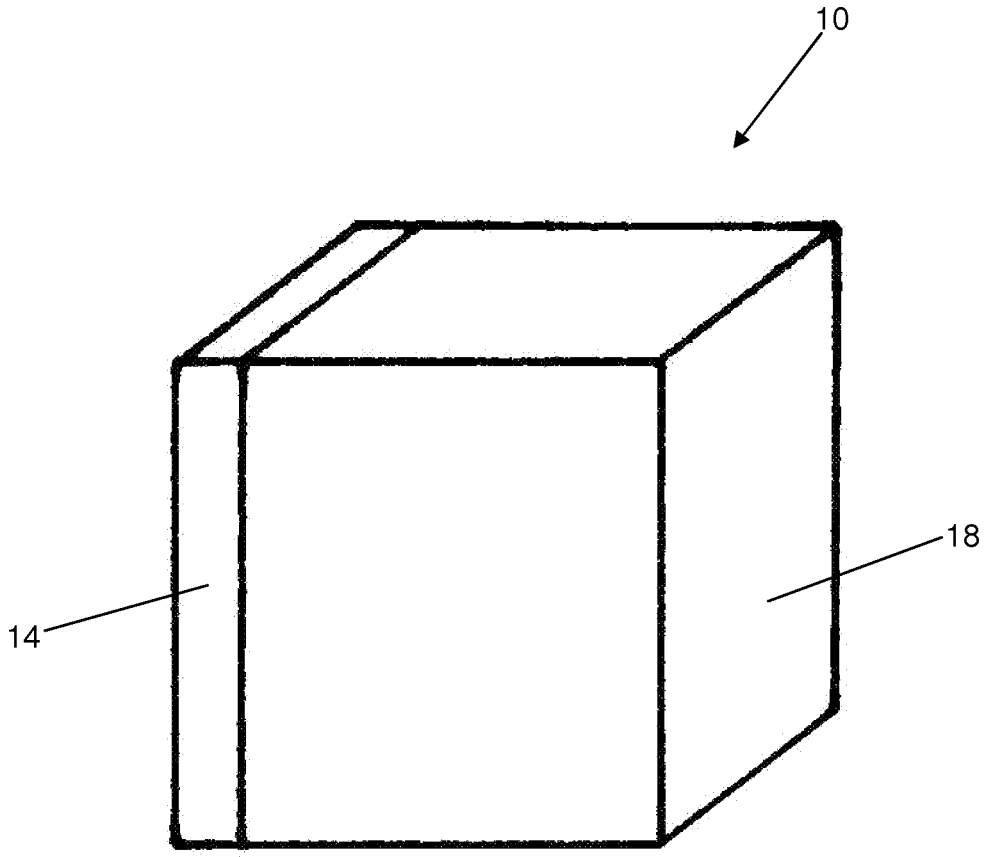
FIG. 1 shows a perspective view of an un-sintered PCD construct according to the present invention.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention will now be discussed in reference to the numerals provided therein so as to enable one skilled in the art to practice the present invention. The description is exemplary of various aspects of the invention and is not intended to narrow the scope of the appended claims.

Applicant has developed new technology for sintering PCD. This allows for the sintering of thick PCD (up to about 0.50" or more) as well as various shapes of PCD. Applicant has also developed a sintering alloy which material has been shown to be extremely biocompatible. These innovations make it possible to use PCD as a bulk material in jewelry such as rings. The development of a biocompatible alloy for sintering diamond has significant implications for jewelry which is worn against the skin as it avoids reactions to the jewelry.

Biocompatibility and hypoallergenicity are critical factors in determining the suitability of a material for jewelry applications. Given the many ways in which jewelry is used to adorn the body, whether worn on the surface of the body, or in piercing applications, there may be significant exposure of the body to the jewelry materials. Until now, it was not possible to fabricate polycrystalline diamond in a biocompatible form. Applicant has developed a polycrystalline diamond material specifically for use in implantable prosthetic devices for use in humans. During the development process, the PCD material has been subjected to extensive testing to evaluate the biological response and the possibility of any toxicity to human tissues. The tests performed include tests routinely employed to screen materials for medical applications, and Applicant's diamond material has been shown to be extremely biocompatible.

It has been discovered that the solvent metal used in sintering the diamond should be between about 33 to 50 percent Sn, about 38 to 45 percent Co, about 10 to 19 percent Cr, and up to about 4 percent Mo. This results in a biocompatible part after sintering. If the solvent metal composition is between about 44 to 48 percent Sn, about 38 to 42 percent Co, about 10 to 14 percent Cr, and up to about 4 percent Mo, biocompatibility is further enhanced. If the solvent metal comprises about 46 percent Sn, about 40 percent Co, about 12 percent Cr, and about 2percent Mo, optimum biocompatibility is achieved, as determined by elution tests of finished parts in Hanks Solution.

Applicants have discovered that the sintering of PCD is a complex chemical process which involves the formation of metal carbides and inter-metallic carbide species and which may also form different metallic phases as well. Thus, the interstitial metal in a sintered PCD is typically not the same composition as the initial metal composition. The interstitial voids between diamond crystals often include various phases of metals and carbides. The above solvent metal composition achieves a sintered PCD where the resulting interstitial metals and carbides are stable and do not show elevated levels of ion elution. The solvent metal composition results in sintered PCD which is fully sintered and which also exhibits good strength and grind resistance.

Applicants have also discovered how to sinter thick PCD structures, allowing the use of PCD for jewelry applications as well as industrial applications requiring thick pieces of PCD. The use of PCD as a bulk or structural jewelry material has several novel advantages when compared with other materials. First and foremost, it is diamond, a material which is held in highest regard as the pinnacle of beauty and luxury in jewelry. Diamond is the hardest known naturally occurring material, and has deep cultural value. When highly polished, PCD has a striking jet-black appearance. The hardness of the PCD surface assures that it will never loose its polish and luster, more so than even that of tungsten jewelry, which PCD easily scratches. PCD is renowned for its toughness and durability being used in the most demanding conditions for oil and gas well drilling and machine tool cutters. PCD should provide a lifetime of continual use without wear or degradation of any kind.

According to the present invention, thick PCD (typically greater than 0.2" and up to 0.5" and greater) can be used as a bulk or structural material in jewelry generally and finger rings specifically. Other applications of this biocompatible diamond material include watch cases, piercing ornaments, etc. This is accomplished by using SnCoCrMo powder (as discussed above) as a sintering alloy material and diamond/metallic powder feed layers at one or both ends of the diamond compact part being sintered.

According to one aspect of the invention, Sn may be mixed with the CoCrMo in various ratios and used as seed metal in the cylinder, or Sn could be used only in the diamond layers. If only Sn is used in the primary diamond layers, the feed layers(s) would generally only use CoCrMo powder. Sn is used to facilitate wetting of the diamond powder during the high temperature and pressure sintering process, which in turn allows the CoCr metal to infiltrate the matrix and act as the primary sintering catalyst metal. By use of this technique, very thick PCD can be produced. FIG. 1 shows such a diamond construct before sintering.

For simplicity in discussing the invention, square constructs of diamond and sintering metal are shown. It is understood that other shapes, such as the cylinders discussed herein, may be formed using the same methodologies. Before sintering, a volume of diamond and sintering metal 10 is formed. The un-sintered PCD construct 10 includes a feed layer 14 and a bulk layer 18. The feed layer 14 is typically smaller than the bulk layer 18, and may be a fraction of the size of the bulk layer as shown. As discussed above, the bulk layer 18 may include diamond powder and a reduced amount of metal. The metal present in the bulk layer 18 may be entirely Sn, or may have an elevated amount of Sn such as containing 65 percent Sn or more. The bulk layer may have between about 5 and 20 percent metal by weight and the balance diamond powder.

The feed layer 14 typically includes diamond powder and an increased amount of metal. The metal present in the feed layer typically has a reduced amount of Sn, and may contain no Sn. The feed layer typically contains between about 50 and 60 percent metal by weight, and more preferably between about 51 and 57 percent meta by weight, and the balance diamond powder. According to a preferred embodiment, the feed layer contains about 57 percent metal by weight. Thus, the construct 10 may have a feed layer 14 which contains about 57 weight percent of a metal which contains about 74 percent Co, 22 percent Cr and 4 percent Mo, the balance being diamond powder, and a bulk layer 18 which contains between about 5 and 20 percent Sn, the balance being diamond powder. More preferably, the bulk layer 18 contains about 20 percent metal by weight and the balance diamond powder. Alternatively, the construct 10 may have a feed layer 14 which contains about 57 weight percent of a sintering metal which contains about 16 percent Sn, 62 percent Co, 19 percent Cr and 3 percent Mo, the balance being diamond powder, and a bulk layer 18 which contains between about 5 and 20 percent of a sintering metal having about 75 percent Sn, 18 percent Co, 6 percent Cr and 1 percent Mo, the balance being diamond powder. As these constructs are sintered, the sintering conditions cause the excess metal in the feed layer 14 to sweep through the bulk layer, pushing impurities out therewith and forming a sintered PCD construct which has a uniform and appropriate composition and amount of metal in the interstitial spaces between diamond crystals.

According to another aspect of the invention, a sintering process may be used which used a feed layer with a higher amount of SnCoCrMo sintering metal and additional diamond material which has a lower amount of the same sintering metal. In such a process, a construct 10 would be formed which has a feed layer 14 with between about 50 and 60 percent of a sintering metal with the SnCoCrMo composition discussed above and the balance diamond powder and which has a bulk layer 18 with between about 5 and 20 percent of the same sintering metal and the balance diamond powder. More preferably, the feed layer has between about 51 and 57 percent metal by weight in the feed layer 14 and between about 15 and 20 percent metal by weight in the bulk layer 18. More preferably still, the feed layer 14 has about 57 percent metal by weight and the bulk layer 18 has about 20 percent metal by weight. Sintering of the construct again causes the excess sintering metal in the feed layer 14 to sweep through the bulk layer 18 and push impurities out of the body of the construct 10, resulting in a higher quality PCD part.

Applicants have discovered that the above SnCoCrMo sintering metal compositions in combination with the methodologies of forming a construct 10 with a feed layer 14 and bulk layer 18 as described, allow for the formation of thicker and larger PCD parts to be sintered. Previously, sintered PCD was limited in thickness, often only about 0.1 inches thick. The present allows PCD parts which are 0.5 inches thick or thicker. The ability to sinter thicker PCD parts and constructs allows for larger finished parts. Industrially, thicker and larger PCD parts may be used to create larger solid PCD bearing roller elements and races or may be used to create oil reservoir drill and cutter bit inserts with thicker and longer lasting wear surfaces. It is thus appreciated that the ability to sinter thicker and larger high quality PCD parts has great industrial significance. It has been determined that the feed layer 14 is preferably about 20 percent or less of the total weight of the construct 10.

Figure 2:
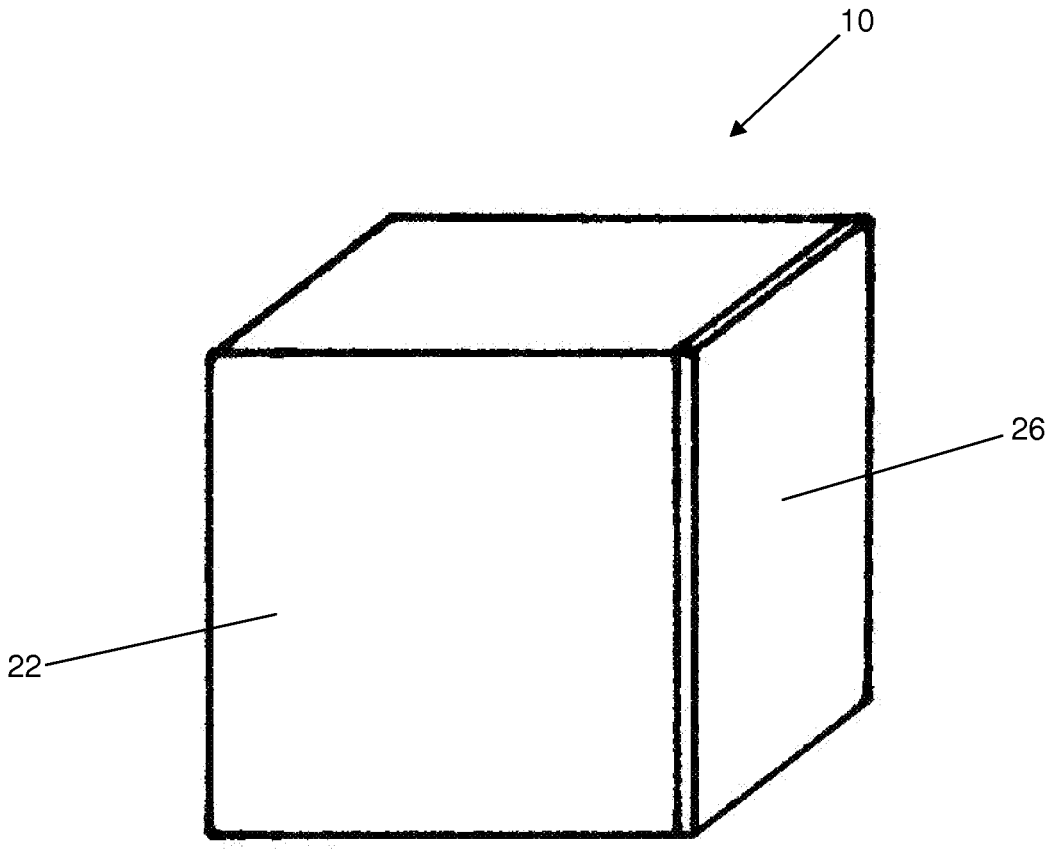
FIG. 2 shows a perspective view of the PCD construct of FIG. 1 after sintering.

FIG. 2 shows a perspective view of the construct 10 of FIG. 1 after sintering. The construct 10 includes a bulk volume of sintered PCD 22. The sintered PCD 22 is fairly uniform in composition as the sintering pressure and conditions cause the sintering metal present in the feed layer 14 and bulk layer 18 to equalize and form a more homogeneous compact. A thin layer 26 of impurities or of PCD with impurities may be formed at one portion of the construct 10 as a result of the movement of the solvent metal from the feed layer 14 and through the bulk layer 18. Although not shown, a small layer of enriched metal content may remain from the feed layer 14.

Another aspect of the present invention uses PCD which is designed to be biocompatible and hypoallergenic as a bulk or structural material in jewelry generally and finger rings specifically. The use of Sn powder mixed in the sintering metal as discussed above produces sintered diamond compacts which are biocompatible.

Figure 3:
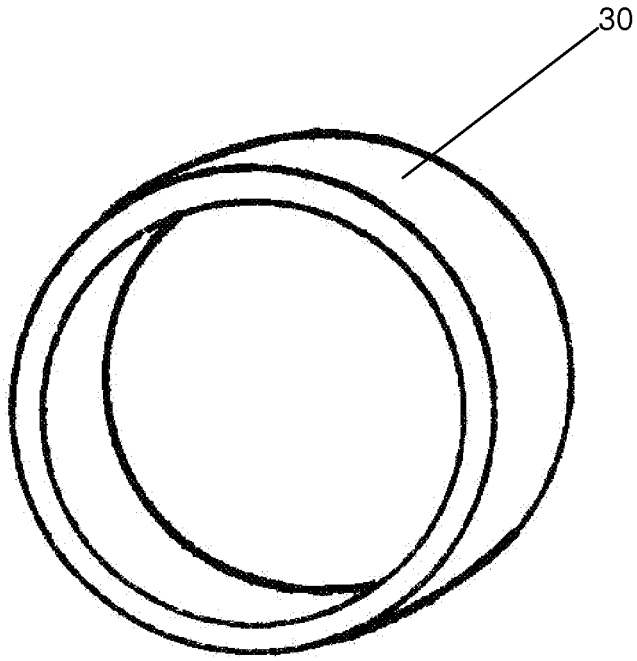
FIG. 3 shows a PCD jewelry ring according to the present invention.

The PCD may be used as the sole bulk or structural material in jewelry. This can be accomplished by using UTPCD (ultra thick PCD). The UTPCD can be formed as "near-net-shape" during the HPHT processing and subsequently machine to various shapes and sizes by the use of Electro Discharge Machining (EDM) process, diamond lapping and brute polishing Another aspect of the present invention includes the use of biocompatible PCD as the outer layer of bulk or structural material in jewelry generally and finger rings specifically. The PCD may be sintered onto various types of metallic substrates, wherein the metallic substrates are biocompatible in substance and provide to basic structural strength for the jewelry construct. The metallic structural core or base structure, when properly prepared is chemically and structurally bonded to the PCD, and can be machined to size and polish finished. Applying PCD to the base structural material is accomplished by "laying up" the diamond powder and sintering metals adjacent to the base metal structure in refractory metal cans and sintering the PCD in the high pressure and temperature environment. The complete PCD/Base Metal structure can now be machined and polished to meet commercial specifications. FIG. 3 shows such a ring 30 made from PCD. The ring 30 may be made from solid sintered PCD. As discussed, thick PCD may be sintered and then machined into a ring.

According to another aspect of the present invention, a hollow diamond cylinder may be sintered using a sacrificial support core. This is accomplished by placing Diamond powder and sintering metal, typically in one (1) to (4) layers, onto a stainless steel base rod. The complete diamond and solid core construct is then sealed in refractory cans, mechanically sealed, and run at sintering conditions allowing the formation of PCD on the outer surface of the solid cylinder.

After being removed from the HPHT (high pressure and temperature) environment, the stainless steel cylinder shrinks away from the PCD as it cools to room temperature leaving a round thin cylinder of PCD. The PCD cylinder is then sliced into "Ring" segments, EDM Machined, lapped and finished to create the final ring product. This allows for the formation of PCD rings with less waste of the PCD material. This is beneficial as the cost of the diamond powder and the energy to sinter the PCD is not inconsequential.

According to the present invention, several PCD rings 30 may be cut from such a PCD cylinder using laser cutting or EDM wire cutting. A PCD cylinder is sliced or cut using EDM wire machine cutting directly thru the cylinder, or a laser cutting machine cutting thru the wall of the cylinder while the cylinder is being rotated during the cutting process.

Laser cutting or EDM wire cutting of PCD may also be used to obtain the initial cylindrical ring form. Cutting a ring from a solid UTPCD cylinder is accomplished by first EDM plunging a small hole through the PCD cylinder, threading through the hole an EDM brass wire and subsequently cutting out the center of the ring to form the initial ring structure.

The invention discloses the use of polished PCD or UTPCD as a bulk or structural material in jewelry generally and finger rings specifically. UTPCD can be EDM wire cut into various gem configurations, lapped and polished to final finishes that are suitable for mounting into rings, pendants ear rings, necklaces, etc. The resulting PCD gem products can be drilled using EDM die sinkers or hole poppers to from attachment surfaces or hanging holes.

The spherical surfaces of PCD may be polished using rings made from PCD cutters. The spherical surfaces PCD rings or gems can be "brute" polished using rings made from standard oil and gas shear cutters providing an economical way of polish processing. The "bruiting rings" are forced against the PCD ring or gem surface to be polished at high pressure while being rotated causing high frictional forces. As the temperature of the PCD rises to approximately 650 Deg C., general diamond degradation takes place allowing for a very high polish on the ring or gem surface. The temperature is controlled by varying the pressure force, rotation of the cutter, and introduction of a cooling liquid.

Matte finished PCD may be used as a bulk or structural material in jewelry generally and finger rings specifically. Matte finishing is accomplished by abrasive blasting of the PCD, and various design patterns may be placed on PCD jewelry by using elastomer mask to protect polished areas from the blast media. Blasting mask fabricated from rubber, neoprene, silicone and other elastomeric materials can be prepared by molding, machining, or photo masking techniques.

High pressure pneumatic abrasive blasting is used to obtain a matte finish in PCD. The erosion of PCD using blasting media such a silicon carbide, aluminum carbide, diamond, and other super hard materials is possible. Generally, blasting erosion is of PCD is not a high speed process, but this condition allows for considerable control in the process depending on the type, size fraction, media volume, and air or liquid pressure being used. Blasting materials with varying harnesses can be used to affect different textures and grades of finishes.

Rings may be formed with a 0.001 to 30.0 degree ring comfort entry angle and the lapping and polishing method to obtain such entry angles. The entry angle may be formed by placing the ring in a suitable holding fixture and introducing a tapered cast iron rod into the ring. Simultaneously the rod is rotated and lapping slurry is introduced. The diameter of the entry angle taper is controlled by the time the rod runs in the ring hole, lapping diamond size fraction, and rod entry force.

Figure 4:
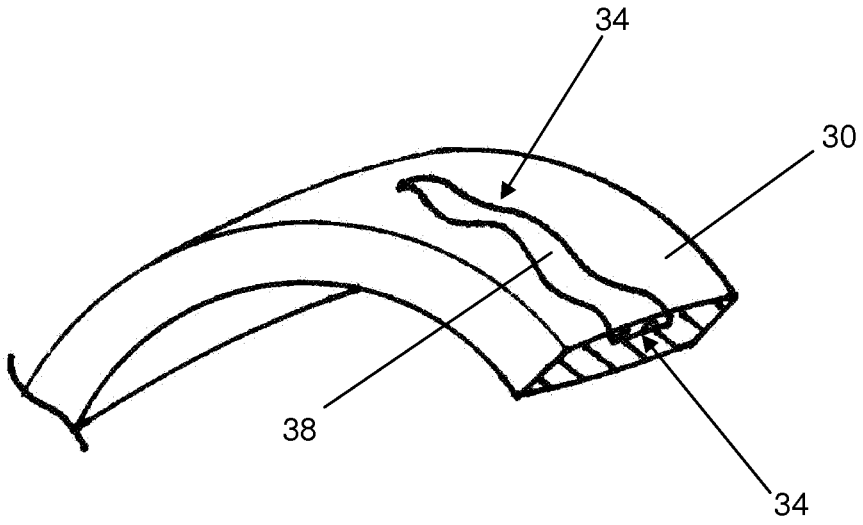
FIG. 4 shows a detail of the PCD ring of FIG. 3.

According to another aspect of the invention, laser cutting or other machining such as EDM machining may be used to cut designs 34 in the PCD jewelry 30 as well as engraving personalized information on the PCD jewelry. FIG. 4 shows such a design. Computer controlled design patterns can be cut into the surface of the PCD jewelry by holding the work piece in a suitable fixture while using a universal gantry driven laser head to orient the laser for angular or normal surface cutting.

By varying the laser power, distance from the work piece, pulse frequency and duration, and infinite array of designs can be produced.

Materials 38 other than PCD may be used to fill the cut designs 34 to enhance the beauty and uniqueness of individual rings 30. Lines and other patterns cut into the PCD jewelry surface can be back filled with various precious metals such as gold, silver, and platinum, to enhance the beauty and uniqueness of individual rings. The metal can be installed in the negative features of the jewelry by the use of torch melting, molten metal dipping, metal plasma spraying, or simple hand stylus lay-down of metal like gold wire or leaf. Once the material has been applied it can be machined to the original surface of the jewelry by lapping and the complete piece polished to the required luster.

Alternatively, ceramic material may be used to fill the laser cut designs to enhance the beauty and uniqueness of individual rings. Ceramic material such as aluminum oxide, yttrium oxide or other suitable hard ceramic material can be introduced to the negative laser cut features of the ring in slip form and later fired to the required hardness. Various colors and designs can be obtained by using glazes. Once the material has been fired it can be machined to the original surface of the jewelry by lapping and the complete piece polished to the required luster.

A polymer based material may also be used to fill the laser cut designs to enhance the beauty and uniqueness of individual rings. Polymers enhanced by colored ceramic or pigmented powders can be introduced into the laser cut negative features of the jewelry surface. Once the material has polymerized it can be machined to the original surface of the jewelry by lapping and the complete piece polished to the required luster.

Figure 5:
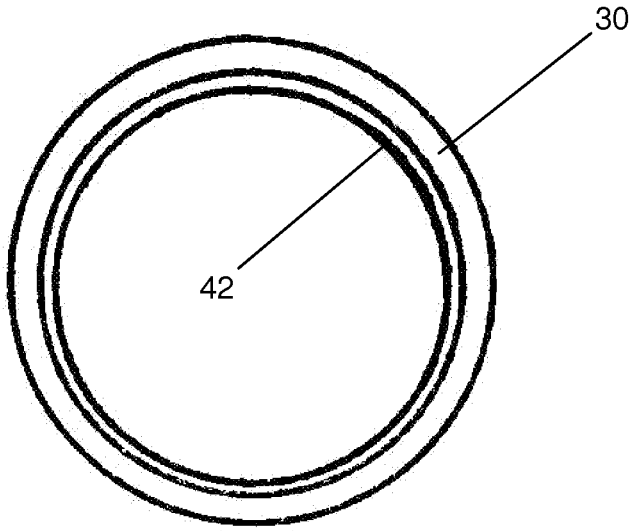
FIG. 5 shows another PCD jewelry ring according to the present invention.

According to another aspect of the invention, a metal ring 42 may be used that is precision fit in the inside diameter of the PCD ring 30 for custom resizing purposes. Such a configuration is shown in FIG. 5. Sizing of a PCD ring for a particular range of sizes can be obtained by grinding the inside diameter of the PCD ring to a very close tolerance, approximately +/_0.0002 inches. A matching "sizing" ring 42 fabricated of a suitable biocompatible material such as stainless steel, titanium or cobalt chrome is inserted into the previously machined bore in the ring 30. The outside diameter of the sizing ring 42 is also machined to very close tolerances and sized to provide a slight interference fit with the ring 30, such as being 0.0005 inches oversize. Various sizing rings 42 can be fabricated with inside diameters which vary to meet the requirements of the ring user. If a different size is required, the current sizing ring is simply pushed out of the ring using a suitable arbor press and a different one re-installed.

Sintered carbide jewelry may also be formed in the manner discussed above, and benefits from the improved biocompatibility of the present sintering metal as well as the improved sintering processes.

There is thus disclosed an improved method and composition for sintering large or thick PCD constructs. The ability to sinter high quality thick PCD constructs allows for use in a variety of industrial applications including but not limited to cutting bits and inserts with thicker diamond layers or larger solid PCD bearing rollers or nozzles. There is also disclosed improved PCD jewelry. It will be appreciated that numerous changes may be made to the present invention without departing from the scope of the claims.

What is claimed is:

1. A sintered compact for use in contact with the body comprising:

a sintered compact, the compact comprising:

a superhard material selected from the group consisting of diamond, cubic boron nitride, and carbide;

a sintering solvent metal, wherein the solvent metal comprises about 33 to 50 percent Sn, about 38 to 45 percent Co, about 10 to 19 percent Cr, and up to about 4 percent Mo by weight.

2. The sintered compact of claim 1, wherein the sintered compact is a ring.

3. The sintered compact of claim 2, wherein the ring comprises a hollow cylindrical body of sintered superhard material and wherein the sintered compact further comprises a hollow cylindrical body of a metal disposed inside of the ring to cover the interior surface of the hollow cylindrical body of sintered superhard material.

4. The sintered compact of claim 1, wherein the sintered compact is an article of jewelry.

5. The sintered compact of claim 1, wherein the solvent metal comprises about 44 to 48 percent Sn, about 38 to 42 percent Co, about 10 to 14 percent Cr, and up to about 4 percent Mo by weight.

6. The sintered compact of claim 1, wherein the solvent metal comprises about 46 percent Sn, about 40 percent Co, about 12 percent Cr, and about 2 percent Mo by weight.

7. The sintered compact of claim 1, wherein the sintered compact comprises a recess which is filled with a different material.

8. A sintered compact comprising:

a sintered diamond compact formed from:

diamond crystals; and a sintering solvent metal comprising about 33 to 50 percent Sn, about 38 to 45 percent Co, and about 10 to 19 percent Cr by weight.

9. The sintered compact of claim 8, wherein the solvent metal further comprises up to about 4 percent Mo by weight.

10. The sintered compact of claim 9, wherein the solvent metal comprises about 44 to 48 percent Sn, about 38 to 42 percent Co, about 10 to 14 percent Cr, and up to about 4 percent Mo by weight.

11. The sintered compact of claim 9, wherein the solvent metal comprises about 46 percent Sn, about 40 percent Co, about 12 percent Cr, and about 2 percent Mo by weight.

12. The sintered compact of claim 8, wherein the article of jewelry is a ring, and wherein the ring comprises a hollow cylindrical body of sintered diamond material and a hollow cylindrical body of a metal attached to the inside of the cylindrical body of diamond material.

* * * * *